US011798496B2

(12) United States Patent
Lim et al.

(10) Patent No.: US 11,798,496 B2
(45) Date of Patent: Oct. 24, 2023

(54) DISPLAY DEVICE FOR CALCULATING COMPRESSION LOSS LEVEL OF COMPENSATION DATA AND DRIVING METHOD THEREOF

(71) Applicant: LG DISPLAY CO., LTD., Seoul (KR)

(72) Inventors: Seho Lim, Gyeonggi-do (KR); Sunwoo Kwun, Incheon (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/876,127

(22) Filed: Jul. 28, 2022

(65) Prior Publication Data

US 2023/0101641 A1 Mar. 30, 2023

(30) Foreign Application Priority Data

Sep. 30, 2021 (KR) ..... 10-2021-0129529

(51) Int. Cl.
*G09G 3/3291* (2016.01)

(52) U.S. Cl.
CPC ... *G09G 3/3291* (2013.01); *G09G 2310/0272* (2013.01)

(58) Field of Classification Search
CPC ..... G09G 3/3291
USPC ..... 345/204
See application file for complete search history.

(56) References Cited

U.S. PATENT DOCUMENTS

2015/0187328 A1* 7/2015 Kim ..... G09G 3/3225 345/83
2017/0069273 A1* 3/2017 Park ..... G09G 3/3233
2017/0092190 A1* 3/2017 Choe ..... G09G 3/2003

* cited by examiner

*Primary Examiner* — Long D Pham
(74) *Attorney, Agent, or Firm* — Morgan, Lewis & Bockius LLP

(57) ABSTRACT

A display device may include areas having a plurality of subpixels. A method for processing and applying a compensation data to the display device may include adjusting a difference between compression loss levels of compensation data of adjacent areas of the display device so that the difference lies within a threshold loss deviation, compressing the compensation data, and applying the compensation data to the adjacent areas. The method can prevent a luminance deviation of the adjacent areas from increasing due to a difference in the compensation levels, and it can also improve an effect of compensation of a degradation of a subpixel in the display device.

19 Claims, 12 Drawing Sheets

DISPLAY DEVICE FOR CALCULATING COMPRESSION LOSS LEVEL OF COMPENSATION DATA AND DRIVING METHOD THEREOF

CROSS REFERENCE TO RELATED APPLICATION

This application claims the benefit of and priority to Korea Patent Application No. 10-2021-0129529, filed on Sep. 30, 2021, the entirety of which is incorporated herein by reference for all purposes.

BACKGROUND

1. Technical Field

The present disclosure relates to devices and methods and particularly to, for example, without limitation, a display device and a method for processing a compensation data of the display device.

2. Discussion of the Related Art

The growth of the information society leads to increased demand for display devices to display images and use of various types of display devices, such as liquid crystal display devices, organic light emitting display devices, and other types of display devices.

The display device may include a display panel in which a plurality of subpixels are disposed, and various driving circuits for driving the plurality of subpixels. Further, at least one circuit element can be disposed in each of the plurality of subpixels.

As a driving time of the display device increases, a degradation of a circuit element disposed in the subpixel can occur. In addition, the degrees of degradation of the circuit elements disposed in different subpixels can be different from each other.

In the case that the degrees of degradation of the circuit elements disposed in different subpixels are different from each other, a driving deviation (or variation) between subpixels can occur, and a display quality can be reduced due to the driving deviation between subpixels.

Thus, methods are needed to prevent a decrease in display quality due to a degradation of the circuit element disposed in the subpixel and the degradation variation (or deviation) between circuit elements disposed in different subpixels.

The description provided in the discussion of the related art section should not be assumed to be prior art merely because it is mentioned in or associated with that section. The discussion of the related art section may include information that describes one or more aspects of the subject technology.

SUMMARY

The inventors of the present disclosure have recognized the problems and disadvantages of the related art and have performed extensive research and experiments. The inventors of the present disclosure have thus invented new methods and devices that substantially obviate one or more problems due to limitations and disadvantages of the related art.

One or more example embodiments of the present disclosure may provide methods of compensating a degradation of a subpixel according to a driving of a display panel, and improving a quality of an image that the display panel displays according to a compensation.

One or more example embodiments of the present disclosure may provide a display device including a display panel in which a plurality of subpixels are disposed, a data driving circuit configured to supply a data voltage to a respective one of the plurality of subpixels, and a controller configured to control the data driving circuit, and process a compensation data for the plurality of subpixels.

A difference between a final compression loss level of a first compensation data for a first subpixel disposed in a first area among the plurality of subpixels and a final compression loss level of a second compensation data for a second subpixel disposed in a second area adjacent to the first area may be less than or equal to a threshold loss deviation.

Alternatively, a difference between a compression loss level of a first compensation data for a first subpixel disposed in a first area among the plurality of subpixels and a compression loss level of a second compensation data for a second subpixel disposed in a second area adjacent to the first area may be greater than a threshold loss deviation, and when restoring, a lost level of some of at least one of the first compensation data or the second compensation data can be increased.

One or more example embodiments of the present disclosure may provide a method for processing a compensation data of a display device including generating the compensation data for a plurality of subpixels, configuring an initial compression loss level of the compensation data, comparing an initial compression loss level of a first compensation data for a first subpixel among the plurality of subpixels and an initial compression loss level of a second compensation data for a second subpixel adjacent to the first subpixel, and configuring a final compression loss level of the first compensation data and a final compression loss level of the second compensation data according to the comparison result.

A difference between the final compression loss level of the first compensation data and the final compression loss level of the second compensation data may be less than or equal to a difference between the initial compression loss level of the first compensation data and the initial compression loss level of the second compensation data.

According to various example embodiments of the present disclosure, by controlling a difference in compression loss levels between adjacent areas so that such difference lies within a threshold loss deviation before compressing a compensation data for a degradation of a subpixel, an image quality reduction due to a difference in compensation levels between the adjacent areas in an image that the compensation data is applied can be reduced or prevented.

Additional features, advantages, and aspects of the present disclosure are set forth in part in the description that follows and in part will become apparent from the present disclosure or may be learned by practice of the inventive concepts provided herein. Other features, advantages, and aspects of the present disclosure may be realized and attained by the descriptions provided in the present disclosure, or derivable therefrom, and the claims hereof as well as the appended drawings. It is intended that all such features, advantages, and aspects be included within this description, be within the scope of the present disclosure, and be protected by the following claims. Nothing in this section should be taken as a limitation on those claims. Further aspects and advantages are discussed below in conjunction with embodiments of the disclosure.

It is to be understood that both the foregoing description and the following description of the present disclosure are exemplary and explanatory, and are intended to provide further explanation of the disclosure as claimed.

BRIEF DESCRIPTION OF THE DRAWINGS

The accompanying drawings, which are included to provide a further understanding of the disclosure, are incorporated in and constitute a part of this disclosure, illustrate embodiments of the disclosure, and together with the description serve to explain principles of the disclosure. In the drawings.

Figure 1:
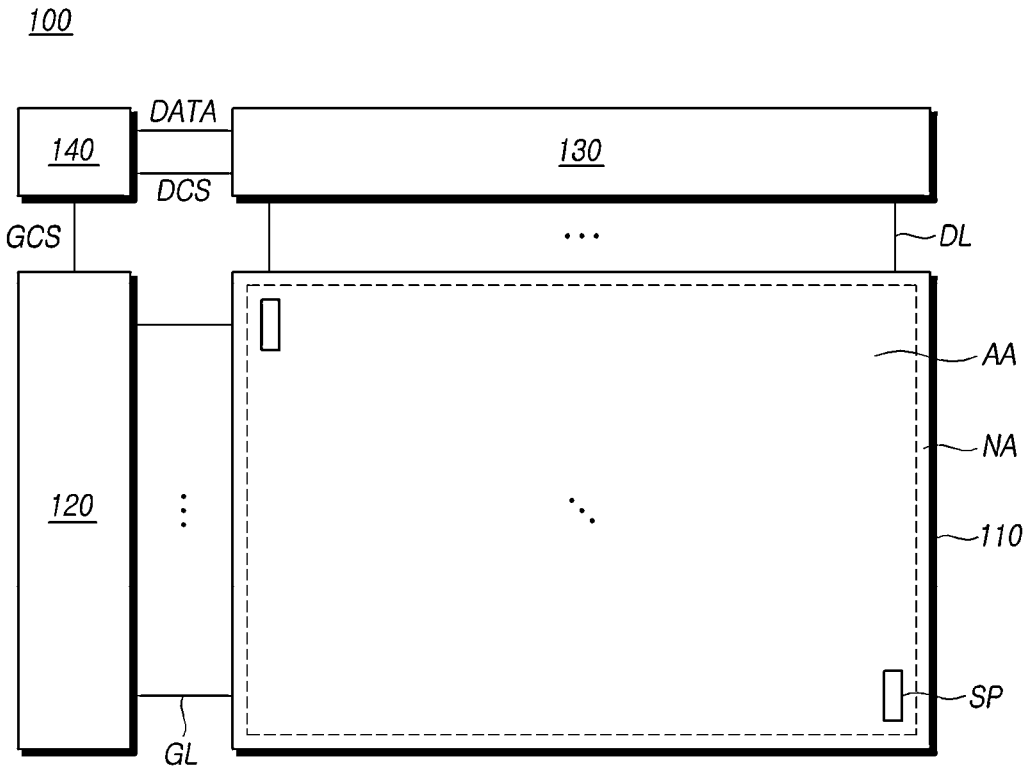
FIG. 1 is a diagram schematically illustrating a configuration of a display device according to one or more example embodiments of the present disclosure.

Throughout the drawings and the detailed description, unless otherwise described, the same drawing reference numerals should be understood to refer to the same elements, features, and structures. The relative size and depiction of these elements may be exaggerated for clarity, illustration, and convenience.

DETAILED DESCRIPTION

Reference is now made in detail to embodiments of the present disclosure, examples of which may be illustrated in the accompanying drawings. In the following description, when a detailed description of well-known functions or configurations may unnecessarily obscure aspects of the present disclosure, the detailed description thereof may be omitted. The progression of processing steps and/or operations described is an example; however, the sequence of steps and/or operations is not limited to that set forth herein and may be changed, with the exception of steps and/or operations necessarily occurring in a particular order.

Unless stated otherwise, like reference numerals refer to like elements throughout even when they are shown in different drawings. In one or more aspects, identical elements (or elements with identical names) in different drawings may have the same or substantially the same functions and properties unless stated otherwise. Names of the respective elements used in the following explanations are selected only for convenience and may be thus different from those used in actual products.

Advantages and features of the present disclosure, and implementation methods thereof, are clarified through the embodiments described with reference to the accompanying drawings. The present disclosure may, however, be embodied in different forms and should not be construed as limited to the embodiments set forth herein. Rather, these embodiments are provided so that this disclosure is thorough and complete and fully conveys the scope of the present disclosure to those skilled in the art. Furthermore, the present disclosure is only defined by claims and their equivalents.

The shapes, sizes, areas, ratios, angles, numbers, and the like disclosed in the drawings for describing embodiments of the present disclosure are merely examples, and thus, the present disclosure is not limited to the illustrated details.

When the term "comprise," "have," "include," "contain," "constitute," "make up of," "formed of," or the like is used, one or more other elements may be added unless a term such as "only" or the like is used. The terms used in the present disclosure are merely used in order to describe particular embodiments, and are not intended to limit the scope of the present disclosure. The terms of a singular form may include plural forms unless the context clearly indicates otherwise. The word "exemplary" is used to mean serving as an example or illustration. Embodiments are example embodiments. Any implementation described herein as an "example" is not necessarily to be construed as preferred or advantageous over other implementations.

In one or more aspects, an element, feature, or corresponding information (e.g., a level, range, dimension, size, or the like) is construed as including an error or tolerance range even where no explicit description of such an error or tolerance range is provided. An error or tolerance range may be caused by various factors (e.g., process factors, internal or external impact, noise, or the like). Further, the term "may" encompasses all the meanings of the term "can."

In describing a positional relationship, where the positional relationship between two parts is described, for example, using "on," "over," "under," "above," "below," "beneath," "near," "close to," or "adjacent to," "beside," "next to," or the like, one or more other parts may be located between the two parts unless a more limiting term, such as "immediate(ly)," "direct(ly)," or "close(ly)," is used. For example, when a structure is described as being positioned "on," "over," "under," "above," "below," "beneath," "near," "close to," or "adjacent to," "beside," or "next to" another structure, this description should be construed as including a case in which the structures contact each other as well as a case in which one or more additional structures are disposed or interposed therebetween. Furthermore, the terms "front," "rear," "back," "left," "right," "top," "bottom," "downward," "upward," "upper," "lower," "up," "down," "column," "row," "vertical," "horizontal," and the like refer to an arbitrary frame of reference.

In describing a temporal relationship, when the temporal order is described as, for example, "after," "subsequent," "next," "before," "preceding," "prior to," or the like, a case that is not consecutive or not sequential may be included unless a more limiting term, such as "just," "immediate(ly)," or "direct(ly)," is used.

It is understood that, although the term "first," "second," or the like may be used herein to describe various elements, these elements should not be limited by these terms. These terms are only used to distinguish one element from another. For example, a first element could be a second element, and, similarly, a second element could be a first element, without departing from the scope of the present disclosure. Furthermore, the first element, the second element, and the like may be arbitrarily named according to the convenience of those skilled in the art without departing from the scope of the present disclosure. The terms "first," "second," and the like may be used to distinguish components from each other, but the functions or structures of the components are not limited by ordinal numbers or component names in front of the components.

In describing elements of the present disclosure, the terms "first," "second," "A," "B," "(a)," "(b)," or the like may be used. These terms are intended to identify the corresponding element(s) from the other element(s), and these are not used to define the essence, basis, order, or number of the elements.

For the expression that an element or layer is "connected," "coupled," or "adhered" to another element or layer, the element or layer can not only be directly connected, coupled, or adhered to another element or layer, but also be indirectly connected, coupled, or adhered to another element or layer with one or more intervening elements or layers disposed or interposed between the elements or layers, unless otherwise specified.

For the expression that an element or layer "contacts," "overlaps," or the like with another element or layer, the element or layer can not only directly contact, overlap, or the like with another element or layer, but also indirectly contact, overlap, or the like with another element or layer with one or more intervening elements or layers disposed or interposed between the elements or layers, unless otherwise specified.

The term "at least one" should be understood as including any and all combinations of one or more of the associated listed items. For example, the meaning of "at least one of a first item, a second item, and a third item" denotes the combination of items proposed from two or more of the first item, the second item, and the third item as well as only one of the first item, the second item, or the third item.

The expression of a first element, a second elements "and/or" a third element should be understood as one of the first, second and third elements or as any or all combinations of the first, second and third elements. By way of example, A, B and/or C can refer to only A; only B; only C; any or some combination of A, B, and C; or all of A, B, and C.

In one or more aspects, the terms "between" and "among" may be used interchangeably simply for convenience unless stated otherwise. For example, an expression "between a plurality of elements" may be understood as among a plurality of elements. In another example, an expression "among a plurality of elements" may be understood as between a plurality of elements. In one or more examples, the number of elements may be two. In one or more examples, the number of elements may be more than two.

In one or more aspects, the terms "each other" and "one another" may be used interchangeably simply for convenience unless stated otherwise. For example, an expression "different from each other" may be understood as being different from one another. In another example, an expression "different from one another" may be understood as being different from each other. In one or more examples, the number of elements involved in the foregoing expression may be two. In one or more examples, the number of elements involved in the foregoing expression may be more than two.

Features of various embodiments of the present disclosure may be partially or wholly coupled to or combined with each other and may be variously inter-operated, linked or driven together. The embodiments of the present disclosure may be carried out independently from each other or may be carried out together in a co-dependent or related relationship. In one or more aspects, the components of each apparatus according to various embodiments of the present disclosure are operatively coupled and configured.

Unless otherwise defined, the terms (including technical and scientific terms) used herein have the same meaning as commonly understood by one of ordinary skill in the art to which example embodiments belong. It is further understood that terms, such as those defined in commonly used dictionaries, should be interpreted as having a meaning that is, for example, consistent with their meaning in the context of the relevant art and should not be interpreted in an idealized or overly formal sense unless expressly defined otherwise herein. For example, the term "part" may apply, for example, to a separate circuit or structure, an integrated circuit, a computational block of a circuit device, or any structure configured to perform a described function as should be understood by one of ordinary skill in the art.

Hereinafter, various example embodiments of the present disclosure are described in detail with reference to the accompanying drawings. For convenience of description, a scale, dimension, size, and thickness of each of the elements illustrated in the accompanying drawings may differ from an actual scale, dimension, size, and thickness, and thus, embodiments of the present disclosure are not limited to a scale, dimension, size, and thickness illustrated in the drawings.

FIG. 1 is a diagram schematically illustrating a configuration of a display device 100 according to one or more example embodiments of the present disclosure. All the components of the display device 100 according to all embodiments of the present disclosure are operatively coupled and configured.

Referring to FIG. 1, the display device 100 may include a display panel 110, and a gate driving circuit 120, a data driving circuit 130 and a controller 140 for driving the display panel 110.

The display panel 110 may include an active area AA where a plurality of subpixels SP is disposed, and a non-active area NA which is located outside the active area AA.

A plurality of gate lines GL and a plurality of data lines DL may be arranged on the display panel 110. The plurality of subpixels SP may be located in areas where the gate lines GL and the data lines DL intersect each other.

The gate driving circuit 120 may be controlled by the controller 140, and sequentially output scan signals to the plurality of gate lines GL arranged on the display panel 110, thereby controlling the driving timing of the plurality of subpixels SP.

The gate driving circuit 120 may include one or more gate driver integrated circuits GDIC, and may be located only at one side of the display panel 110, or may be located at both sides thereof according to a driving method.

Each gate driver integrated circuit GDIC may be connected to a bonding pad of the display panel 110 by a tape automated bonding TAB method or a chip-on-glass COG method. Alternatively, each gate drive integrated circuit GDIC may be implemented by a gate-in-panel GIP method to then be directly arranged on the display panel 110. Alternatively, the gate driver integrated circuit GDIC may be integrated and arranged on the display panel 110. Alternatively, each gate driver integrated circuit GDIC may be implemented by a chip-on-film COF method in which an element is mounted on a film connected to the display panel 110.

The data driving circuit 130 may receive image data from the controller 140 and convert the image data into an analog data voltage Vdata. Then, the data driving circuit 130 may output the data voltage Vdata to each data line DL according to the timing at which the scan signal is applied through the gate line GL so that each of the plurality of subpixels SP emits light having brightness according to the image data.

The data driving circuit 130 may include one or more source driver integrated circuits SDIC.

Each source driver integrated circuit SDIC may include a shift register, a latch circuit, a digital-to-analog converter, an output buffer, and the like.

Each source driver integrated circuit SDIC may be connected to a bonding pad of the display panel 110 by a tape automated bonding TAB method or a chip-on-glass COG method. Alternatively, each source driver integrated circuit SDIC may be directly disposed on the display panel 110. Alternatively, the source driver integrated circuit SDIC may be integrated and arranged on the display panel 110. Alternatively, each source driver integrated circuit SDIC may be implemented by a chip-on-film COF method. In this case, each source driver integrated circuit SDIC may be mounted on a film connected to the display panel 110, and may be electrically connected to the display panel 110 through wires on the film.

The controller 140 may supply various control signals to the gate driving circuit 120 and the data driving circuit 130, and may control the operation of the gate driving circuit 120 and the data driving circuit 130.

The controller 140 may be mounted on a printed circuit board, a flexible printed circuit, or the like, and may be electrically connected to the gate driving circuit 120 and the data driving circuit 130 through the printed circuit board, the flexible printed circuit, or the like.

The controller 140 may allow the gate driving circuit 120 to output a scan signal according to the timing implemented in each frame. The controller 140 may convert a data signal received from the outside to conform to the data signal format used in the data driving circuit 130 and then output the converted image data to the data driving circuit 130.

The controller 140 may receive, from the outside (e.g., a host system), various timing signals including a vertical synchronization signal VSYNC, a horizontal synchronization signal HSYNC, an input data enable DE signal, a clock signal CLK, and the like, as well as the image data.

The controller 140 may generate various control signals using various timing signals received from the outside, and may output the control signals to the gate driving circuit 120 and the data driving circuit 130.

For example, in order to control the gate driving circuit 120, the controller 140 may output various gate control signals GCS including a gate start pulse GSP, a gate shift clock GSC, a gate output enable signal GOE, or the like.

The gate start pulse GSP may control the operation start timing of one or more gate driver integrated circuits GDIC constituting the gate driving circuit 120. The gate shift clock GSC, which is a clock signal commonly input to one or more gate driver integrated circuits GDIC, may control the shift timing of a scan signal. The gate output enable signal GOE may specify the timing information on one or more gate driver integrated circuits GDIC.

In addition, in order to control the data driving circuit 130, the controller 140 may output various data control signals DCS including a source start pulse SSP, a source sampling clock SSC, a source output enable signal SOE, or the like.

The source start pulse SSP may control a data sampling start timing of one or more source driver integrated circuits SDIC constituting the data driving circuit 130. The source sampling clock SSC may be a clock signal for controlling the timing of sampling data in the respective source driver integrated circuits SDIC. The source output enable signal SOE may control the output timing of the data driving circuit 130.

The display device 100 may further include a power management integrated circuit for supplying various voltages or currents to the display panel 110, the gate driving circuit 120, the data driving circuit 130, and the like or controlling various voltages or currents to be supplied thereto.

Each subpixels SP may be an area defined by a cross of the gate line GL and the data line DL, and at least one circuit element including a light-emitting element may be disposed in a subpixel SP.

For example, in the case that the display device 100 is an organic light-emitting display device, an organic light-emitting diode OLED and various circuit elements may be disposed in the plurality of subpixel SP. By controlling a current supplied to the organic light-emitting diode OLED by the various circuit elements, each subpixel may produce (or represent) a luminance corresponding to the image data.

Alternatively, in some cases, a light-emitting diode LED or micro light-emitting diode μLED may be disposed in the subpixel SP.

Figure 2A:
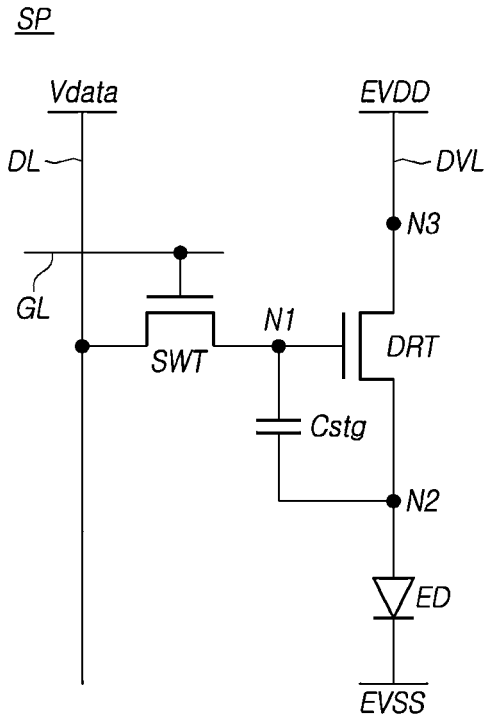
FIGS. 2A and 2B are diagrams illustrating an example of a circuit structure of a subpixel included in a display device according to one or more example embodiments of the present disclosure.
Figure 2B:
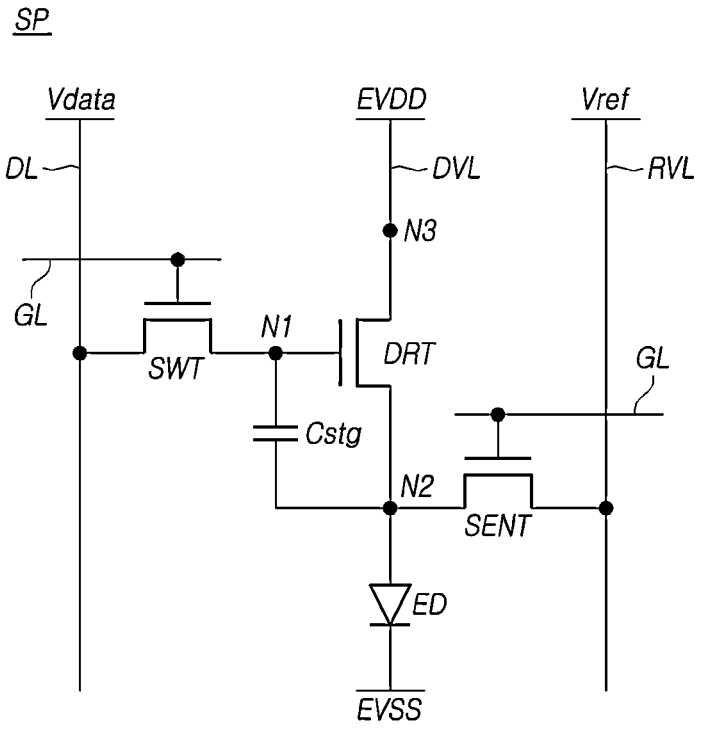

FIGS. 2A and 2B are diagrams illustrating an example of a circuit structure of a subpixel SP included in the display device 100 according to example embodiments of the present disclosure.

Referring to FIGS. 2A and 2B, a light-emitting element ED and a driving transistor DRT for driving the light-emitting element ED may be disposed in the subpixel SP. Furthermore, at least one circuit element other than the light-emitting element ED and the driving transistor DRT may be further disposed in the subpixel SP.

For example, as illustrated in FIG. 2A, a switching transistor SWT and a storage capacitor Cstg may be further disposed in the subpixel SP.

For another example, as illustrated in FIG. 2B, the switching transistor SWT, a sensing transistor SENT and the storage capacitor Cstg may be further disposed in the subpixel SP.

Thus, FIG. 2A illustrates two thin film transistors and one capacitor (which may be referred to as a 2T1C structure) other than the light-emitting element ED are disposed in the subpixel SP as an example. FIG. 2B illustrates three thin film transistors and one capacitor (which may be referred to as a 3T1C structure) other than the light-emitting element ED are disposed in the subpixel SP. But embodiments of the present disclosure are not limited to these.

Furthermore, examples illustrated in FIG. 2A and FIG. 2B illustrate that all of the thin film transistors are an N type, but in some cases, the thin film transistor disposed in a subpixel SP may be a P type.

Referring to FIG. 2A, the switching transistor SWT may be electrically connected between the data line DL and a first node N1. The data voltage Vdata may be supplied to the subpixel SP through the data line DL. The first node N1 may be a gate node of the driving transistor DRT.

The switching transistor SWT may be controlled by a scan signal supplied to the gate line GL. The switching transistor SWT may provide a control so that the data voltage Vdata supplied through the data line DL is applied to the gate node of the driving transistor DRT.

The driving transistor DRT may be electrically connected between a driving voltage line DVL and the light-emitting element ED.

A second node N2 of the driving transistor DRT may be electrically connected to the light-emitting element ED. The second node N2 may be a source node or a drain node of the driving transistor DRT.

A third node N3 of the driving transistor DRT may be electrically connected to the driving voltage line DVL. The third node N3 may be the drain node or the source node of the driving transistor DRT. A first driving voltage EVDD may be supplied to the third node N3 of the driving transistor DRT through the driving voltage line DVL. The first driving voltage EVDD may be a high potential driving voltage.

The driving transistor DRT may be controlled by a voltage applied to the first node N1. The driving transistor DRT may control a driving current supplied to the light-emitting element ED.

The storage capacitor Cstg may be electrically connected between the first node N1 and the second node N2. The storage capacitor Cstg may maintain the data voltage Vdata applied to the first node N1 during one frame.

The light-emitting element ED may be electrically connected between the second node N2 and a line that a second driving voltage EVSS is supplied. The second driving voltage EVSS may be a low potential driving voltage.

The light-emitting element ED may produce (or represent) a luminance according to the driving current supplied through the driving transistor DRT.

In this respect, the subpixel SP may further include the switching transistor SWT other than the driving transistor DRT, and may produce (or represent) a luminance according to the image data by driving the light-emitting element ED.

Alternatively, the subpixel SP may further include the sensing transistor SENT as illustrated in FIG. 2B.

The sensing transistor SENT may be electrically connected between a reference voltage line RVL and the second node N2. A reference voltage Vref may be supplied to the second node N2 through the reference voltage line RVL.

The sensing transistor SENT may be controlled by the scan signal supplied to the gate line GL. The gate line GL controlling the sensing transistor SENT may be identical to or different from the gate line GL controlling the switching transistor SWT.

The sensing transistor SENT may control that the reference voltage Vref is applied to the second node N2. Furthermore, the sensing transistor SENT, in some cases, may control that a voltage of the second node N2 is sensed through the reference voltage line RVL.

In this respect, in a structure that the sensing transistor SENT is further disposed in the subpixel SP, a luminance according to the image data may be produced (or represented) by controlling a driving of the light-emitting element ED. Furthermore, a change of a characteristic value of a circuit element disposed in the subpixel SP may be detected by the sensing transistor SENT and the reference voltage line RVL.

For the subpixel SP producing (or representing) a luminance according to the image data, an accurate control of the driving transistor DRT and the light-emitting element ED is required. However, as a driving time increases, the characteristic value of the driving transistor DRT or the light-emitting element ED may be changed due to a degradation.

For example, a threshold voltage or a mobility of the driving transistor DRT may be changed. Furthermore, a threshold voltage of the light-emitting element ED may be changed.

A variation (or deviation) of the characteristic values between the subpixels SP may occur due to a change of the characteristic values of the driving transistor DRT and the light-emitting element ED. The variation (or deviation) of the characteristic values between the subpixels SP may affect a quality of an image produced (or represented) through the display panel 110.

In the case that the sensing transistor SENT and the reference voltage line RVL are disposed in the subpixel SP, a change in the characteristic value of the subpixel SP may be sensed through the reference voltage line RVL and the change of the characteristic value may be compensated, but real time compensation can be difficult since a period for the sensing is required.

Furthermore, as illustrated in FIG. 2A, in the case of a structure in which the reference voltage line RVL is not disposed, it can be difficult to detect a change of the characteristic value of the subpixel SP.

One or more example embodiments of the present disclosure provide methods of compensating a change in the characteristic value of a circuit element disposed in a subpixel SP in real time, and preventing a decrease in display quality due to a degradation of the circuit element. In this regard, one or more example embodiments of the present disclosure provide a sensing-less compensation system (e.g., a system including a degradation management circuit 300 and a storage unit 400 illustrated in FIG. 3), which can compensate a change in the characteristic value of a circuit element in a subpixel SP without using a sensing transistor SENT or a reference voltage line RVL to sense or detect such change for the purpose of compensating such change. In one or more examples, a sensing-less compensation can compensate a change in the characteristic value of a circuit element in a subpixel SP without sensing the subpixel SP (or without sensing the operation of the subpixel SP) for the purpose of compensating such change.

In one or more aspects of the present disclosure, the amount of change in the characteristic value of a subpixel SP may indicate (or may be) a degradation amount of the subpixel SP. In addition, the degradation amount of the subpixel SP may indicate (or may be) the amount of change in the characteristic value of at least one of the driving transistor DRT or the light-emitting element ED disposed in the subpixel SP.

Figure 3:
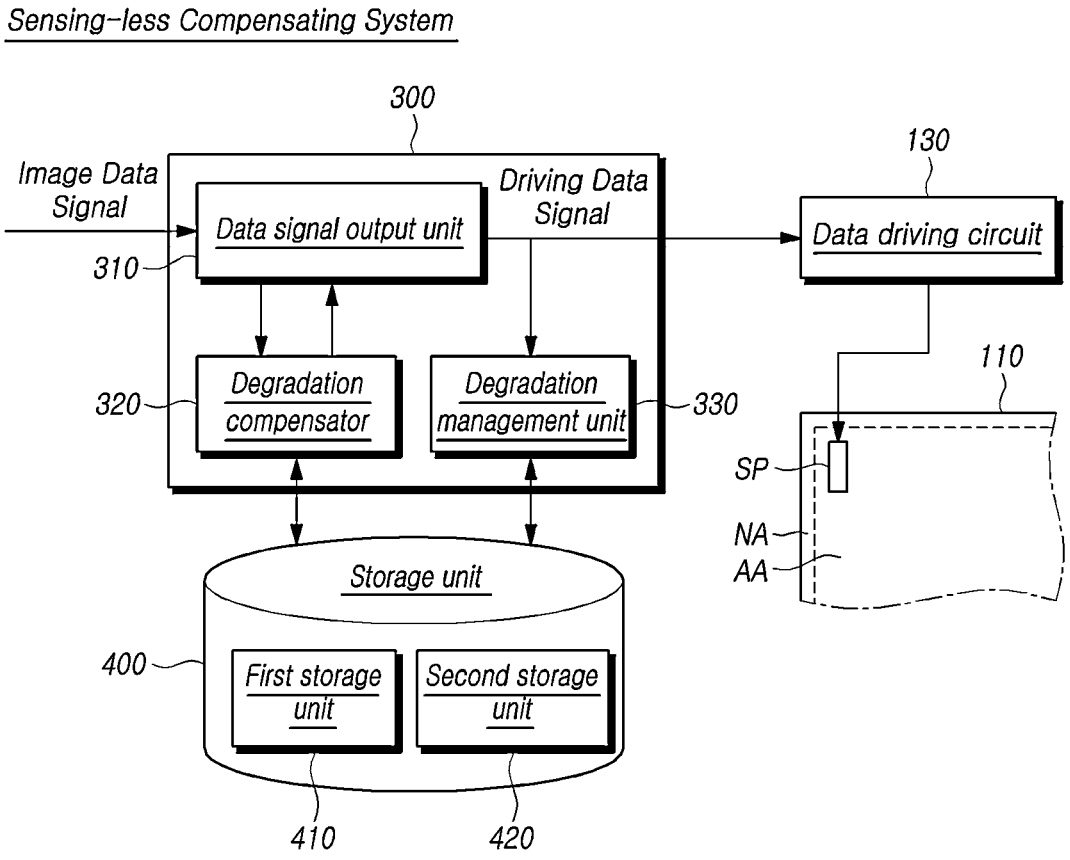
FIG. 3 is a diagram illustrating a schematic configuration of a sensing-less compensating system according to one or more example embodiments of the present disclosure.
Figure 4:
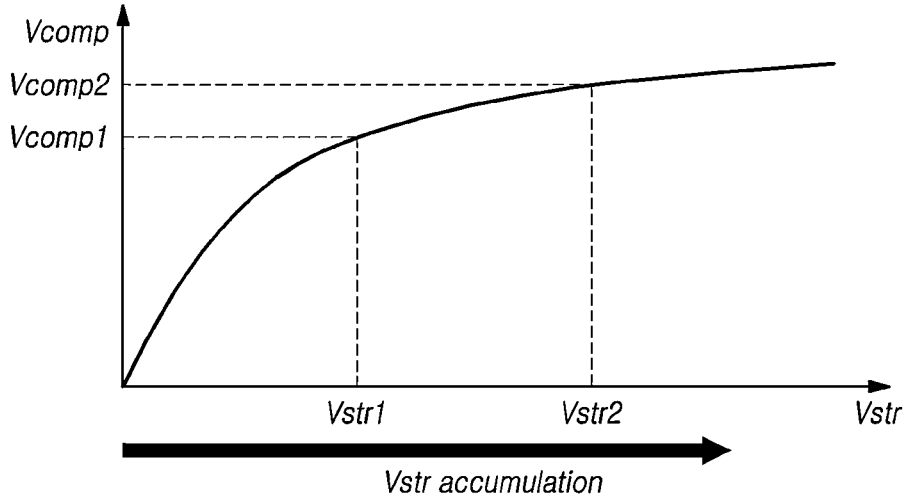
FIG. 4 is a diagram illustrating an example of real time compensation by a sensing-less compensating system according to one or more example embodiments of the present disclosure.

FIG. 3 is a diagram illustrating a schematic configuration of a sensing-less compensating system according to one or more example embodiments of the present disclosure. FIG. 4 is a diagram illustrating an example of real time compensation by the sensing-less compensating system according to one or more example embodiments of the present disclosure.

Referring to FIG. 3, the sensing-less compensating system according to example embodiments of the present disclosure may include a degradation management circuit 300 and a storage unit 400. At least one of the degradation management circuit 300 or the storage unit 400 may be included in the controller 140. Alternatively, at least one of the degradation management circuit 300 or the storage unit 400 may be placed outside of the controller 140. Alternatively, in some cases, some of the components included in the degradation management circuit 300 and some of the components included in the storage unit 400 may be included in the controller 140.

The degradation management circuit 300 may include a data signal output unit 310, a degradation compensator 320 and a degradation management unit 330.

The data signal output unit 310 may receive an image data signal from outside. The data signal output unit 310 may output a driving data signal to the data driving circuit 130. The driving data signal may be produced by adding a compensation data to the image data signal.

The data signal output unit 310 may check (or obtain) the compensation data to be added to the image data signal using the degradation compensator 320.

The degradation compensator 320 may determine a degradation degree of the circuit element disposed in each of the plurality of subpixels SP based on data stored in the storage unit 400. The degradation compensator 320 may check (or determine or obtain) a compensation value corresponding to the degradation degree of the circuit element and may output the compensation value to the data signal output unit 310.

The storage unit 400 may store data representing a degradation degree of the circuit element disposed in each of the plurality of subpixels SP. Furthermore, the storage unit 400 may store data related to the compensation value corresponding to the degradation degree.

For example, the storage unit 400 may include a first storage unit 410 and a second storage unit 420.

The first storage unit 410 may store data related to the degradation degree of the circuit element which is accumulated in real time according to a driving of the subpixel SP. The data which is stored in the first storage unit 410 and is related to a real time degradation degree of each subpixel SP may be referred to as an accumulated stress data. The accumulated stress data may be sometimes referred to as the compensation data. Alternatively, in some cases, a compensation value corresponding to the accumulated stress data may be referred to as the compensation data.

The second storage unit 420 may store the compensation data corresponding to the accumulated stress data. The second storage unit 420, for example, may store the compensation data corresponding to the accumulated stress data using a look-up table.

The data signal output unit 310 may check (or determine or obtain) the compensation data for the accumulated stress data of the subpixel SP using the degradation compensator 320, and may output, to the data driving circuit 130, the driving data signal which is a signal generated by adding the compensation data to the image data signal. In this respect, the driving data signal is based on the compensation data and the image data signal. In one aspect, the compensation data is reflected in the driving data signal, and the image data signal is reflected in the driving data signal.

The data driving circuit 130 may supply the data voltage Vdata according to the driving data signal to the subpixel SP. Thus, the data voltage Vdata may be supplied to the subpixel SP. In one or more aspects, the compensation data according to the degradation degree of the subpixel SP is reflected in the data voltage Vdata. In one or more aspects, the data voltage Vdata is based on the compensation data and the degradation degree of the subpixel SP.

For example, as illustrated in FIG. 4, if the accumulated stress data is a first stress value Vstr1, the driving data signal in which a first compensation value Vcomp1 corresponding to the first stress value Vstr1 is reflected may be input to the data driving circuit 130. If the accumulated stress data is a second stress value Vstr2, the driving data signal in which a second compensation data Vcomp2 corresponding to the second stress value Vstr2 is reflected may be input to the data driving circuit 130. In this regard, in one or more aspects, a driving data signal is based on a first compensation value Vcomp1 corresponding to the first stress value Vstr1. In one or more aspects, a driving data signal is based on a second compensation data Vcomp2 corresponding to the second stress value Vstr2.

The data driving circuit 130 may supply, to the subpixel SP, the data voltage Vdata in which the compensation data according to the accumulated stress data of the subpixel SP is reflected in real time. In this regard, in one or more aspects, a data voltage Vdata is based on the compensation data according to the accumulated stress data of the subpixel SP. A degradation of the circuit element disposed in the subpixel SP may be compensated in real time, and a driving of the subpixel SP may be performed.

The accumulated stress data of the subpixel SP may be updated in real time in a process that the subpixel SP is driven.

The degradation management unit 330 may receive the driving data signal that the data signal output unit 310 outputs.

As the data voltage Vdata according to the driving data signal is supplied to the subpixel SP, a degradation of the subpixel SP corresponding to the driving data signal can be progressed.

The degradation management unit 330 may update the accumulated stress data of the subpixel SP stored in the storage unit 400 according to the driving data signal.

As the accumulated stress data of the subpixel SP is updated by the degradation management unit 330 during a driving of the subpixel SP, information related to a degradation of the circuit element disposed in the subpixel SP can be updated and managed in real time.

The degradation management unit 330 may compress and store at least some of the accumulated stress data of the subpixel SP.

Figure 5:
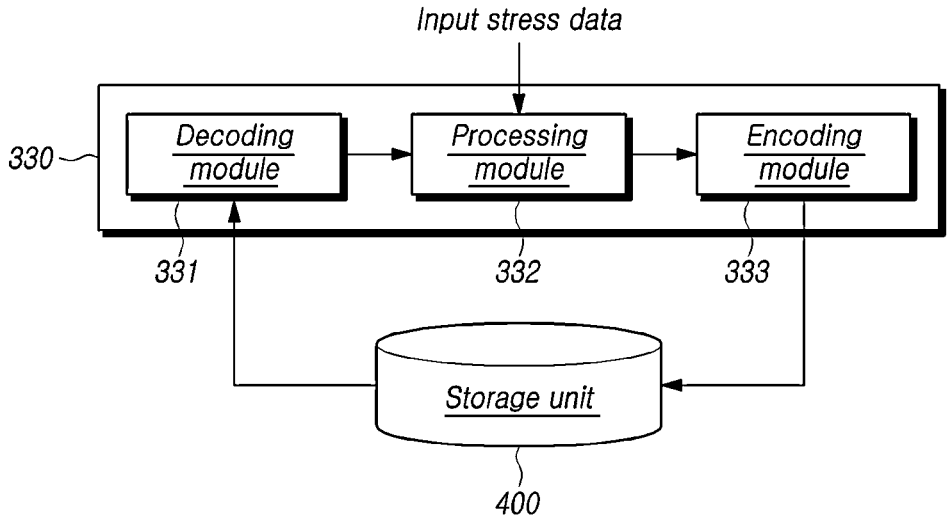
FIG. 5 is a diagram illustrating a schematic configuration of a degradation management unit of a sensing-less compensating system according to one or more example embodiments of the present disclosure.

FIG. 5 is a diagram illustrating a schematic configuration of the degradation management unit 330 of the sensing-less compensating system according to one or more example embodiments of the present disclosure.

Referring to FIG. 5, the degradation management unit 330 may include a decoding module 331, a processing module 332 and an encoding module 333.

The processing module 332 of the degradation management unit 330 may receive an input stress data according to a driving of the subpixel SP when the driving of the subpixel SP is performed. The input stress data may be data corresponding to the driving data signal described above, or data calculated based on the driving data signal.

The processing module 332 may update the accumulated stress data by adding the input stress data to a pre-stored accumulated stress data.

The pre-stored accumulated stress data may be stored in the storage unit 400 as compressed data.

The decoding module 331 may restore the pre-stored accumulated stress data in the storage unit 400 and output to the processing module 332.

The processing module 332 may generate an updated accumulated stress data by adding the restored accumulated stress data and the input stress data. The processing module 332 may output the updated accumulated stress data to the encoding module 333.

The encoding module 333 may compress the updated accumulated stress data and store the compressed accumulated stress data in the storage unit 400.

The encoding module 333 may lossless-compress at least some of the accumulated stress data. The encoding module 333 may loss-compress at least some of the accumulated stress data.

As the encoding module 333 performs a lossless-compression and a loss-compression together, a storage efficiency of the accumulated stress data can be improved while minimizing loss of the accumulated stress data.

The encoding module 333 may determine a compression loss level according to the accumulated stress data which is an object to be compressed. The compression loss level may be determined according to a size or a complexity of the accumulated stress data.

For example, if a size or a complexity of the accumulated stress data is great, the compression loss level of the accumulated stress data may be high. In an opposite case, the compression loss level of the accumulated stress data may be low (or small). For example, when a size or complexity of the accumulated stress data is small (or less), the compression loss level of the accumulated stress data may be low (or less or small). A compression loss level may be configured independently or differently according to a respective area.

Figure 6:
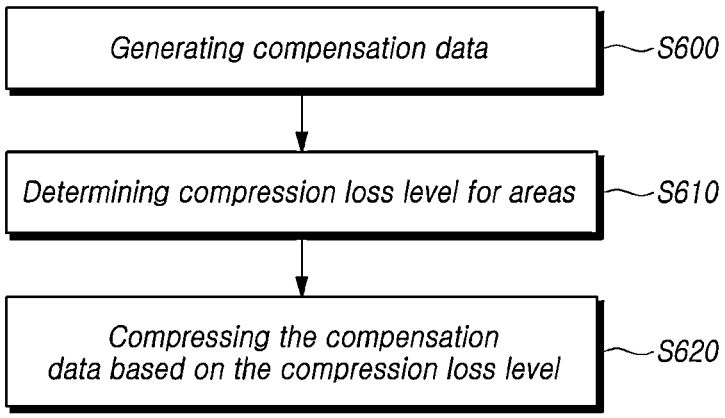
FIG. 6 is a flowchart illustrating an example of a method for processing a compensation data of a display device according to one or more example embodiments of the present disclosure.
Figure 7:
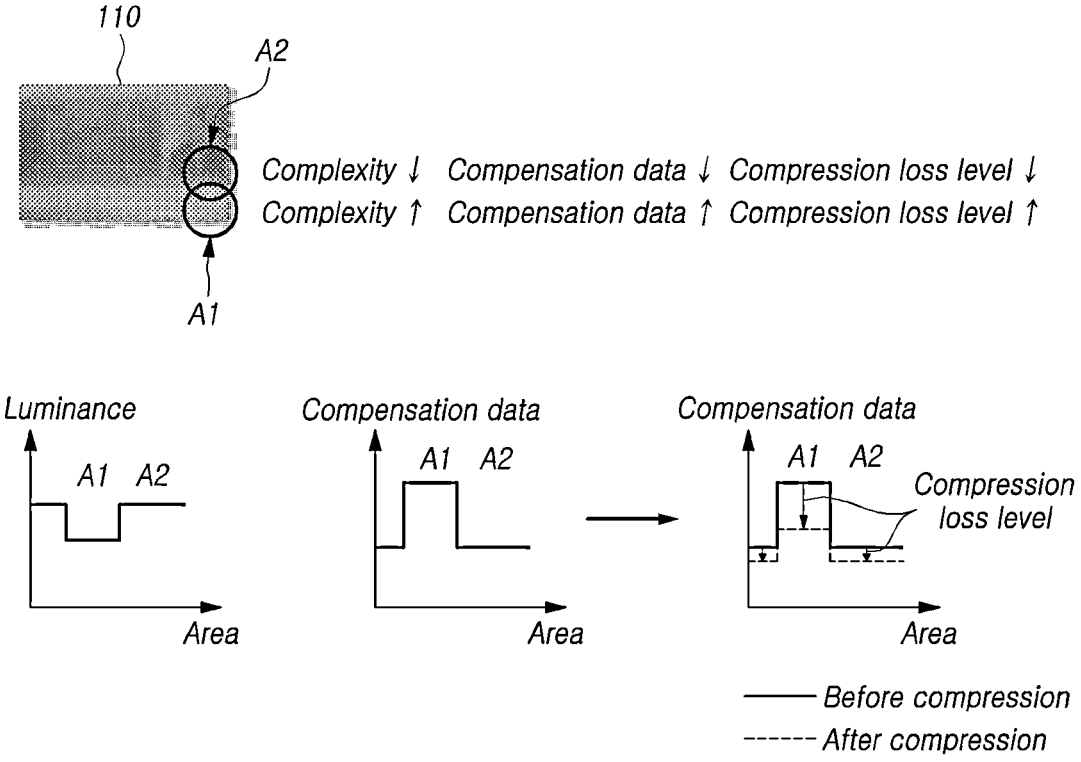
FIG. 7 is a diagram illustrating a specific example of a method for processing a compensation data of a display device illustrated in FIG. 6.

FIG. 6 is a flowchart illustrating an example of a method for processing the compensation data of the display device 100 according to one or more example embodiments of the present disclosure. FIG. 7 is a diagram illustrating a specific example of a method for processing the compensation data of the display device 100 illustrated in FIG. 6.

Referring to FIG. 6, the compensation data for compensating a characteristic variation (or deviation) of the subpixel SP disposed in the display panel 110 may be generated at S600. The compensation data, for example, may be generated by the controller 140.

In one or more example embodiments described below, a case that the compensation data is generated and managed by the controller 140 is described as an example, but the compensation data may be processed by one or more other components in the display device 100 or by one or more external components (e.g., a host system).

The compensation data may indicate (or may be or may be based on) the accumulated stress data which is accumulated according to a driving of the subpixel SP (e.g., according to a driving data signal supplied to the data driving circuit 130 for driving the subpixel SP).

Alternatively, in some cases, the compensation data may indicate (or may be or may be based on) a data for compensating a luminance deviation (or variation) according to a characteristic of the subpixel SP. In this case, a luminance that the subpixel SP produces (represents) may be measured and the compensation data may be generated based on the measured luminance. Alternatively, the amount of current flowing in the subpixel SP may be measured when the subpixel SP is driven and the compensation data may be generated based on the measured current amount.

The compensation data may be compressed before being stored. The compression loss level for a compression of the compensation data may be determined. The compression loss levels for compression of the compensation data may be determined for areas of the display panel 110 at S610.

In the case that the compensation data is a data for compensating the degradation of the subpixel SP according to a driving of the display panel 110, a degradation degree of the subpixel SP may be different according to areas of the display panel 110. A size or a complexity of the compensation data may be different due to a difference in degradation degrees among different subpixels SP. In one or more aspects, as the compensation data can be compressed according to a compression ratio which is pre-determined, it may be required that the compression loss level is configured differently according to a size or a complexity of the compensation data.

Referring to FIG. 7, a luminance that the display panel 110 produces (or represents) may be reduced due to the degradation of the subpixel SP in the display panel 110. As the degradation degrees may vary (or may be different) among different subpixels SP, the amount (or degree) of reduction in luminance may be different among different areas of the display panel 110.

For example, as illustrated in FIG. 7, a degree of reduction in luminance of a first area A1 can be greater than a degree of reduction in luminance of a second area A2.

The first area A1 and the second area A2 may be areas located on one line. For example, the first area A1 and the second area A2 may indicate (or may be or may represent) areas which are driven by one or more same gate lines GL or driven by one or more same data lines DL. Alternatively, the first area A1 and the second area A2 may be areas divided as a block unit in the active area AA.

The first area A1 and the second area A2 may be (or may represent) areas which have similar degradation degrees. However, a method of dividing (or classifying) the first area A1 and the second area A2 is not limited to a certain method.

A complexity or a size of the compensation data for the subpixel SP located in the first area A1 which has a large reduction in luminance can be greater than a complexity or a size of the compensation data for the subpixel SP located in the second area A2 which has a lesser (or smaller) reduction in luminance.

When the compensation data is compressed, the compression loss level may be determined by area. For example, the compression loss level may be determined by the degradation management circuit 300, degradation management unit 330, or the encoding module 333.

For example, the compression loss level of the compensation data for the subpixel SP located in the first area A1, where the degradation degree is great, can be greater than the compression loss level of the compensation data for the subpixel SP located in the second area A2, where the degradation degree is relatively small.

In this regard, in one or more aspects, the compression loss level for a compression of the compensation data can be configured independently or differently according to the area of the active area AA. For example, the compression loss level may be set differently based on the area of the active area AA, and the compression loss level of one area may be different from that of another area within the active area AA.

When the compression loss level is determined, a compression of the compensation data may be performed according to the determined compression loss level at S620.

The compensation data may be restored and used to compensate for a deviation in the characteristic values between the subpixels SP when the display device 100 is driven.

In this regard, in one or more aspects, because the compression loss level can be determined for each area, even if a difference in degradation degrees is present among different subpixels SP, the compensation data may be compressed and stored, and the deviation compensation of the subpixels SP (e.g., compensating for a deviation in the characteristic values between the subpixels SP) by the compensation data may be performed.

Furthermore, one or more example embodiments of the present disclosure may provide methods of compensating the deviation (or variation) of the subpixel SP by the compensation data and improving a quality of an image represented according to a compensation level, by determining the compression loss level of the compensation data for each area and adjusting a difference in the compression loss levels of adjacent areas.

Figure 8:
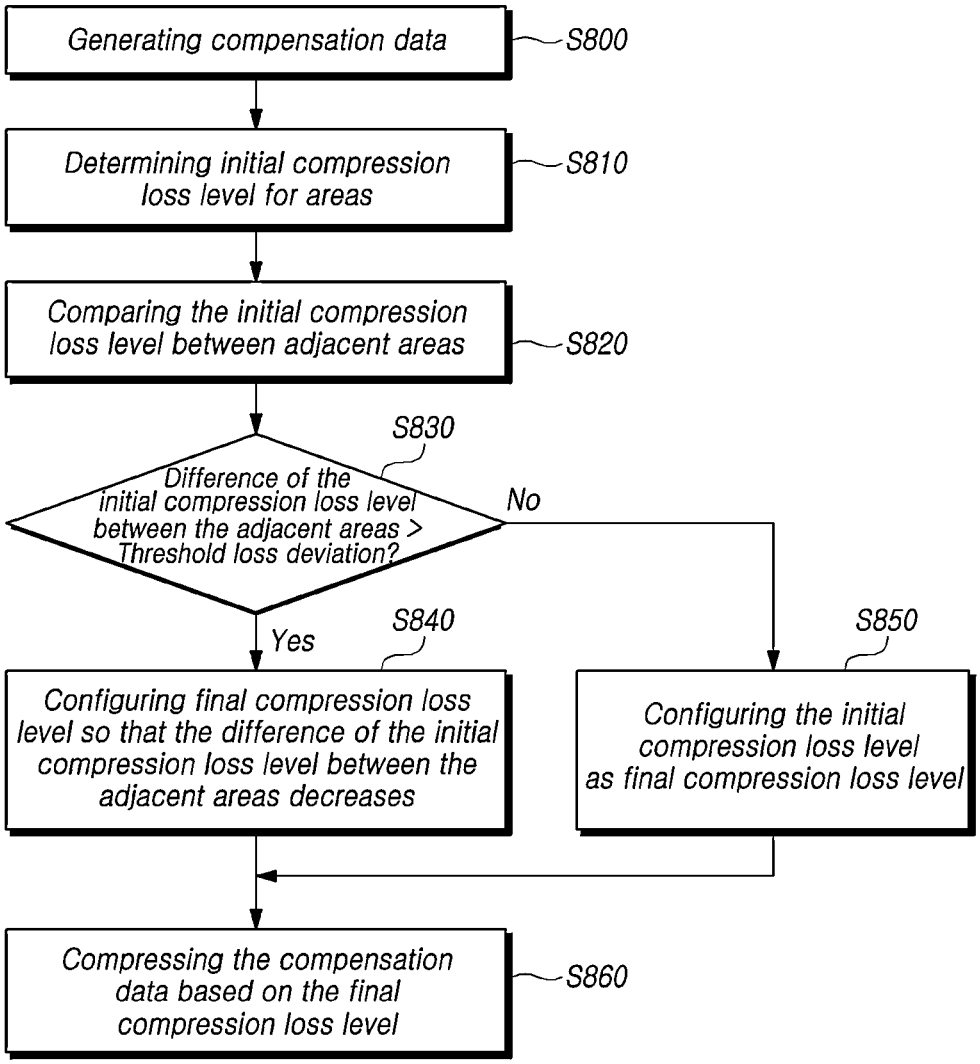
FIG. 8 is a flowchart illustrating another example of a method for processing a compensation data of a display device according to one or more example embodiments of the present disclosure.

FIG. 8 is a flowchart illustrating another example of a method for processing the compensation data of the display device 100 according to one or more example embodiments of the present disclosure.

Figure 9:
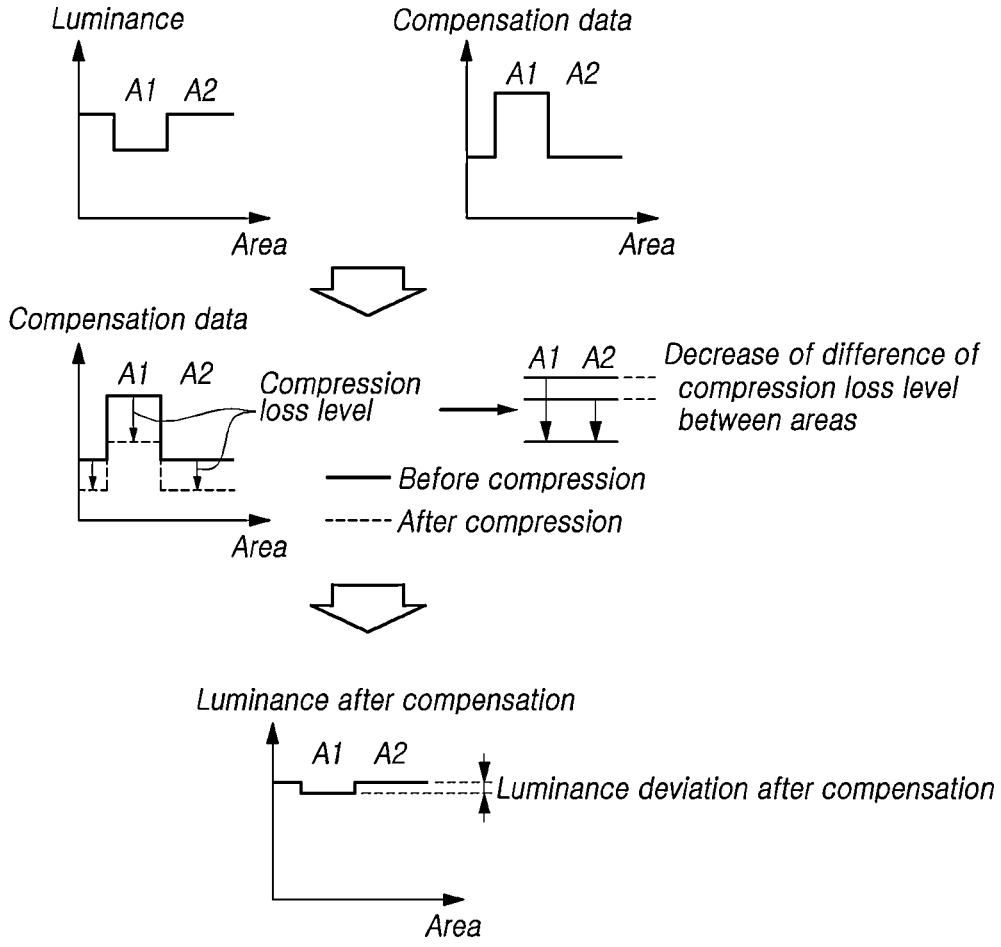
FIG. 9 is a diagram illustrating a specific example of a method for processing a compensation data of a display device illustrated in FIG. 8.

FIG. 9 is a diagram illustrating a specific example of a method for processing the compensation data of the display device 100 illustrated in FIG. 8.

Referring to FIG. 8, the controller 140 (or the degradation management circuit 300 or the degradation compensator 320) may generate the compensation data for a characteristic deviation compensation of the subpixel SP at S800.

The compensation data, such as described above, may be the accumulated stress data according to the driving of the subpixel SP. Alternatively, the compensation data may indicate (or may be or may represent) a compensation value corresponding to the accumulated stress data. The compensation data may be a data for compensating the luminance deviation (or variation) of the subpixel SP.

The controller 140 may determine an initial compression loss level for each area in the active area AA based on the compensation data at S810.

The initial compression loss level may be determined based on the compensation data. For example, if a complexity of the compensation data is great or a size of the compensation data is great, the initial compression loss level can be configured high. If the complexity of the compensation data is small or the size of the compensation data is small, the initial compression loss level can be configured low.

At S820, the controller 140 may compare the initial compression loss levels between adjacent areas when the initial compression loss level is determined.

If a difference in the initial compression loss levels between adjacent areas is greater than a threshold loss deviation at S830, the controller 140 may configure a final compression loss level so that the difference in the initial compression loss levels between adjacent areas is reduced at S840.

In one or more examples, a threshold loss deviation may refer to a threshold amount of deviation (or difference) between compression loss levels. In one or more aspects, a threshold loss deviation may refer to an allowable loss deviation (e.g., an amount of deviation allowed between compression loss levels to prevent adverse results such as a decrease in display quality due to the degradation variation between subpixels). In one or more examples, a threshold loss deviation may be a value predetermined or preset (e.g., by the controller 140). In this respect, in one or more examples, a threshold loss deviation may be a predeteremined threshold loss deviation. An allowable loss deviation may be a preset allowable loss deviation.

For example, the final compression loss level for each area may be configured so that the difference in the final compression loss levels between adjacent areas is less than or equal to the threshold loss deviation.

If the difference in the initial compression loss levels between adjacent area is less than or equal to the threshold loss deviation at S830, the controller 140 may configure the initial compression loss level for each area as the final compression loss level at S850.

At S860, the controller 140 may compress the compensation data based on the configured final compression loss levels for areas.

Referring to an example illustrated in FIG. 9, the degree of a luminance reduction in the first area A1 may be greater than the degree of a luminance reduction in the second area A2 due to the degradation of the subpixels SP disposed in the display panel 110. The first area A1 and the second area A2 may be areas located adjacent to each other.

The compensation data for the subpixel SP located in the first area A1 may be greater than the compensation data for the subpixel SP located in the second area A2.

Thus, the initial compression loss level for the first area A1 may be great. The initial compression loss level for the second area A2 may be relatively smaller than the initial compression loss level for the first area A1.

The controller 140 may increase the initial compression loss level for the second area A2 to configure the final compression loss level for the second area A2. The controller 140 may configure the initial compression loss level for the first area A1 as the final compression loss level for the first area A1.

A difference between the final compression loss level for the first area A1 and the final compression loss level for the second area A2 may be smaller than a difference between the initial compression loss level for the first area A1 and the initial compression loss level for the second area A2.

A compression of the compensation data may be performed based on the final compression loss level.

As a difference in the compression loss levels between the first area A1 and the second area A2 (located adjacent to each other) decreases, in the case that the compensation data compressed according to the compression loss level configured for each area is restored and used for the compensation of the subpixel SP, a deviation between luminance that each area produces (or represents) after the compensation can be reduced.

According to one or more example embodiments of the present disclosure, the compensation for the degradation of the first area A1 and the second area A2 can be performed, and such compensation can prevent a quality of an image, to which the compensation is applied, from being reduced due to a variation (deviation) of compensation levels.

A process for reducing a difference in the compression loss levels of adjacent areas may be performed repeatedly. This can prevent a difference in the compensation levels of adjacent areas from being increased during the process of adjusting the compression loss level.

Figure 10:
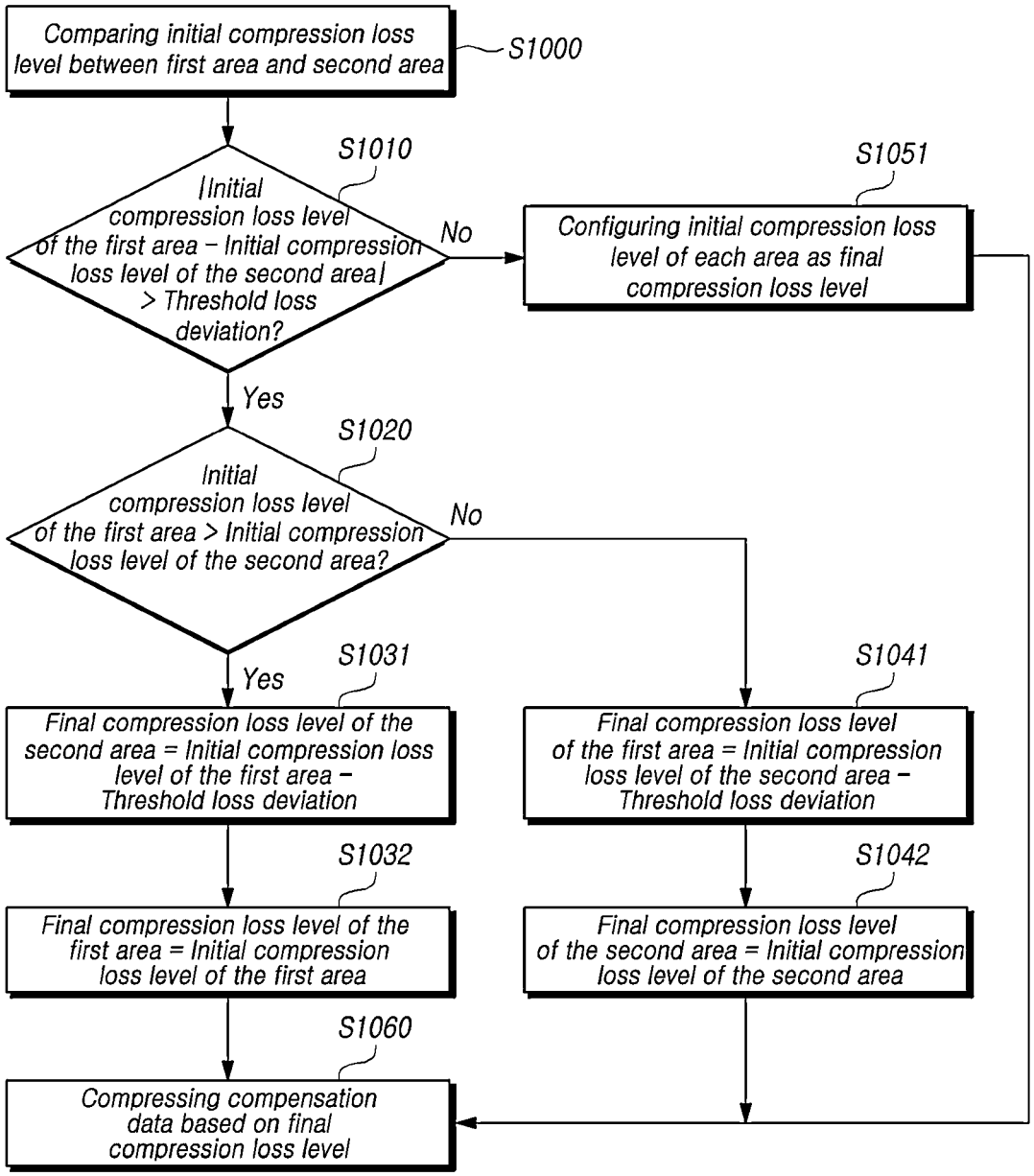
FIG. 10 is a flowchart illustrating still another example of a method for processing a compensation data of a display device according to one or more example embodiments of the present disclosure.

FIG. 10 is a flowchart illustrating still another example of a method for processing the compensation data of the display device 100 according to one or more example embodiments of the present disclosure.

Figure 11:
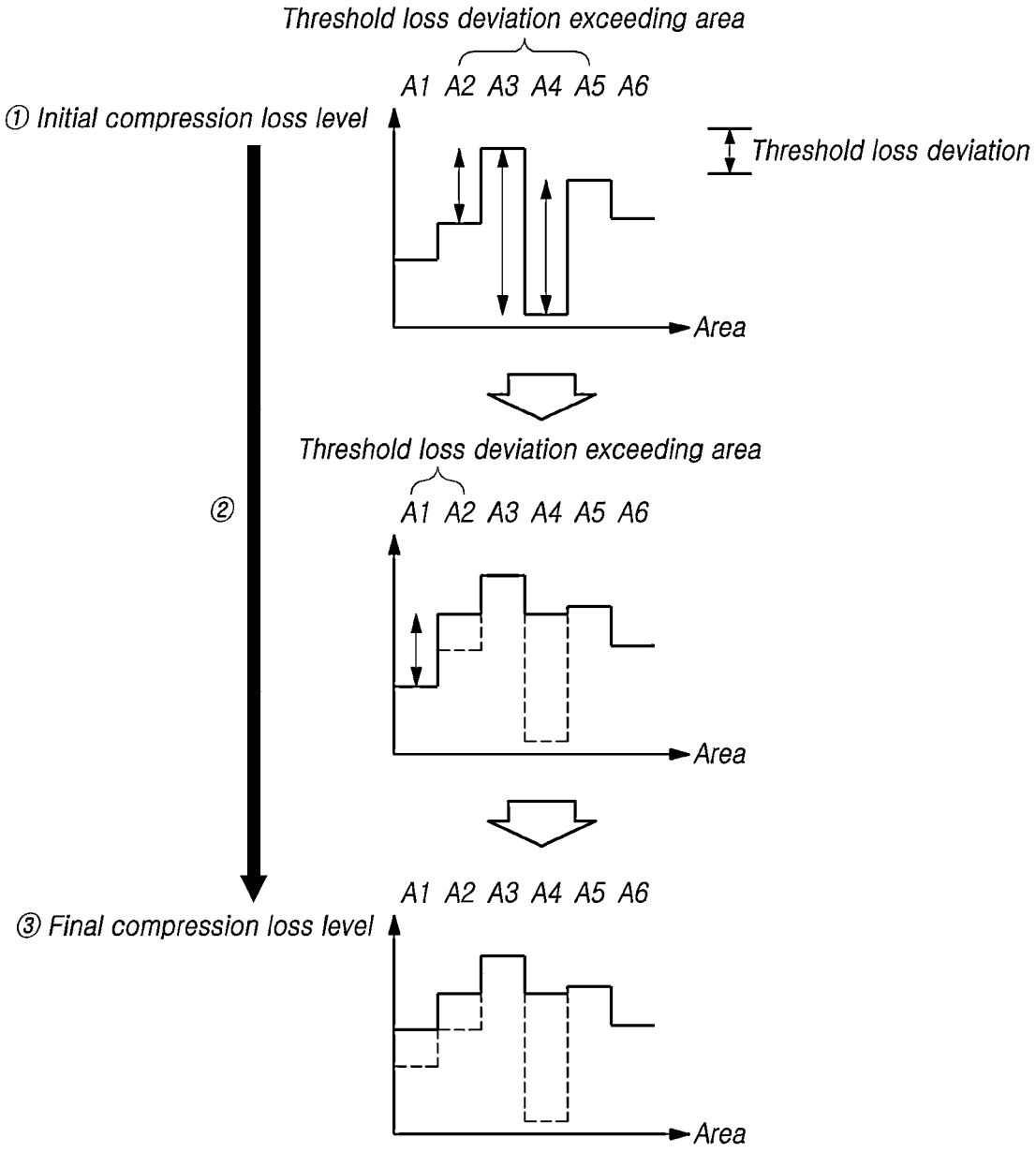
FIG. 11 is a diagram illustrating a specific example of a method for processing a compensation data of a display device illustrated in FIG. 10.

FIG. 11 is a diagram illustrating a specific example of a method for processing the compensation data of the display device 100 illustrated in FIG. 10.

Referring to FIG. 10, the controller 140 may determine the initial compression loss level for each area for a compression of the compensation data. The controller 140 may compare the initial compression loss levels of the first area A1 and the second area A2 located adjacent to each other at S1000.

If a difference between the initial compression loss level of the first area A1 and the initial compression loss level of the second area A2 is greater than the threshold loss deviation at S1010, the controller 140 may compare the initial compression loss level of the first area A1 and the initial compression loss level of the second area A2.

If the initial compression loss level of the first area A1 is greater than the initial compression loss level of the second area A2 at S1020, the controller 140 may determine (or calculate) the final compression loss level of the second area A2 by substracting the threshold loss deviation from the initial compression loss level of the first area A1 at S1031.

The controller 140 may configure (or set) the initial compression loss level of the first area A1 as the final compression loss level of the first area A1 at S1032.

A difference in the compression loss levels between areas can be reduced by increasing the compression loss level of the second area A2 while maintaining the compression loss level of the first area A1.

An example illustrated in FIG. 10 represents a method of reducing a difference in the compression loss levels between the first area A1 and the second area A2 by a method in which the threshold loss deviation is subtracted from the initial compression loss level of the first area A1, but various other methods may be used by the controller 140 so that a difference in the compression loss levels between areas is less than or equal to the threshold loss deviation.

If the initial compression loss level of the first area A1 is less than the initial compression loss level of the second area A2 at S1020, the controller 140 may determine the final compression loss level of the first area A1 by substracting the threshold loss deviation from the initial compression loss level of the second area A2 at S1041.

The controller 140 may configure the initial compression loss level of the second area A2 as the final compression loss level of the second area A2 at S1042.

If a difference between the initial compression loss level of the first area A1 and the initial compression loss level of the second area A2 is less than or equal to the threshold loss deviation at S1010, the controller 140 may configure the initial compression loss level of each area as the final compression loss level of the corresponding area at S1051.

The controller 140 may compress the compensation data based on the final compression loss level for each area at S1060.

In this regard, in one or more aspects, a process of reducing a difference in the compression loss levels between adjacent areas may be performed repeatedly until a difference in the compression loss levels between adjacent areas becomes not greater than the threshold loss deviation.

Referring to FIG. 11, as indicated by ①, the initial compression loss level may be configured (or determined or set) according to the compensation data. FIG. 11 illustrates an example in which the initial compression loss levels for six areas A1, A2, A3, A4, A5, and A6 located adjacent to one another are configured.

As indicated by ① of FIG. 11, among six areas A1, A2, A3, A4, A5, and A6, a difference between the initial compression loss level of the second area A2 and the initial compression loss level of the third area A3 can be greater than the threshold loss deviation. A difference between the initial compression loss level of the third area A3 and the initial compression loss level of the fourth area A4 can be greater than the threshold loss deviation. A difference between the initial compression loss level of the fourth area A4 and the initial compression loss level of the fifth area A5 can be greater than the threshold loss deviation.

Thus, in this example, the second area A2 to the fifth area A5 may be areas exceeding the threshold loss deviation.

In this case, such as an example illustrated in FIG. 10, a value obtained by substracting the threshold loss deviation from the greatest (or greater) value among the initial compression loss levels of adjacent areas may be configured as a new compression loss level for an area of which the initial compression loss level is small.

For example, a value obtained by substracting the threshold loss deviation from the initial compression loss level of the third area A3 may be configured as a new compression loss level for the second area A2. A value obtained by substracting the threshold loss deviation from the initial compression loss level of the third area A3 may be configured as a new compression loss level of the fourth area A4.

In these processes, a difference in the compression loss levels of adjacent areas, for which a difference in the initial compression loss levels is less than or equal to the threshold loss deviation, may become greater than the threshold loss deviation.

For example, as the initial compression loss level of the second area A2 increases to the new compression loss level of the second area A2, a difference in the compression loss levels between the second area A2 and the first area A1 may become greater than the threshold loss deviation.

A difference between the initial compression loss level of the first area A1 and the initial compression loss level of the second area A2 may be less than or equal to the threshold loss deviation. However, in the process of adjusting a difference in the compression loss levels between the second area A2 and the third area A3, a difference in the compression loss levels between the first area A1 and the second area A2 may become greater than the threshold loss deviation.

Thus, as indicated by ②, the process of adjusting the difference in the compression loss levels between different areas may be repeated until a difference in the compression loss levels between adjacent areas is within the range of the threshold loss deviation (or does not exceed the predetermined threshold loss deviation).

A value obtained by substracting the threshold loss deviation from the new compression loss level of the second area A2 may be configured as new compression loss level of the first area A1.

A difference in the compression loss levels between the first area A1 and the second area A2 may become less than or equal to the threshold loss deviation.

The above-mentioned process may be performed repeatedly and if a difference in the compression loss levels between adjacent areas does not exceed the threshold loss deviation, then a process of adjusting the compression loss levels may be terminated. As indicated by ③, the final compression loss level for each area may be configured so that a difference in the compression loss levels of each set of adjacent areas is less than or equal to the threshold loss deviation.

For example, for areas A1, A2, A3, A4, A5, and A6, a difference in the final compression loss levels between the first area A1 and the second area A2 does not exceed the threshold loss deviation; a difference in the final compression loss levels between the second area A2 and the third area A3 does not exceed the threshold loss deviation; a difference in the final compression loss levels between the third area A3 and the fourth area A4 does not exceed the threshold loss deviation; a difference in the final compression loss levels between the fourth area A4 and the fifth area A5 does not exceed the threshold loss deviation; and a difference in the final compression loss levels between the fifth area A5 and the sixth area A6 does not exceed the threshold loss deviation.

In this case, a difference in the compression loss levels between two areas where one or more additional areas are interposed therebetween may be greater than the threshold loss deviation. For example, in an example illustrated in FIG. 11, a difference between the final compression loss level of the first area A1 and the final compression loss level of the third area A3 may be greater than the threshold loss deviation.

The above-mentioned process may be terminated in this state, or in some cases, the process may be performed repeatedly until a difference in the final compression loss levels between two non-adjacent areas (e.g., the first area A1 and the third area A3) becomes less than or equal to the threshold loss deviation also.

In this regard, in one or more aspects, because the compression is performed after configuring the final compression loss levels where a difference in the compression loss levels between adjacent areas is within the range of the threshold loss deviation, the compensation system and method according to one or more example embodiments can prevent a quality of an image, to which the compensation data is applied, from being reduced due to the variation (deviation) in compensation levels between subpixels SP, and an effect of the compensation of the degradation of the subpixels SP can be improved.

Various example embodiments and aspects of the present disclosure are described below for convenience. These are provided as examples, and do not limit the subject technology. Some of the examples described below are illustrated with respect to the figures disclosed herein simply for illustration purposes without limiting the scope of the subject technology.

In one or more examples, a host system may be a computer, a computer system, or a system with a processor. In one or more examples, a host system does not include a display device 100. In one or more examples, a host system does not include a controller 140. In one or more examples, a host system does not include any of a degradation management circuit 300 or a storage unit 400. In one or more examples, a host system does not include any of a controller 140, a gate driving circuit 120, a data driving circuit 130, and a display panel 110.

In one or more examples, the controller 140 may include the degradation management circuit 300 and its components (e.g., any or all of the data signal output unit 310, the degradation compensator 320, the degradation management unit 330, the decoding module 331, the processing module 332, and the encoding module 333). The controller 140 may also include the storage unit 400.

The controller 140 may perform the the methods (e.g., the processes, steps, operations, actions, and functions) of the degradation management circuit 300 and its components. The controller 140 may perform the the methods (e.g., the processes, steps, operations, actions, and functions) of the storage unit 400.

The controller 140 may include (or may be) a processor that may be configured to execute code or instructions to perform the operations and functionality described herein and to perform calculations and generate commands. In one or more examples, each processing component of the controller 140 (e.g., the degradation management circuit 300 and each of its components) may include (or may be) a processor or one or more components of a processor. The processor of the controller 140 and/or its components may be configured to monitor and/or control the operation of the components in the display device 100.

A processor may be, for example, a microprocessor, a microcontroller, or a digital signal processor. A processor may be implemented as, for example, an application specific integrated circuit, a field programmable gate array, a programmable logic device, a state machine, logic gates, or components or some combination of the foregoing.

One or more sequences of instructions for the methods described herein may be stored within the controller 140, the storage unit 400, and/or some components thereof. The storage unit 400 may include (or may be), for example, one or more memories (e.g., read-only-memory, non-volatile memory, volatile memory, random access memory, flash memory, or some combination thereof). One or more sequences of instructions for the methods described herein may be software or firmware stored and read from the controller 140, the storage unit 400, or some components thereof (e.g., its/their processor(s)), or received from a host system. The storage unit 400 or a portion of the controller 140 may be an example of a non-transitory computer readable medium on which instructions or code executable by the controller 140 and/or its components (e.g., its/their processor(s)) may be stored. A computer readable medium may refer to a non-transitory medium used to provide instructions to the controller 140 and/or its components (e.g., its/their processor(s)). A medium may include one or more media. A processor may include one or more processors or one or more sub-processors. A processor of the controller 140 and/or its component may be configured to execute code, may be programmed to execute code, or may be operable to execute code, where such code may be stored in the controller 140, the storage unit 400 and/or some components thereof.

In one or more examples, the controller 140 and/or its components (e.g., its/their processor(s)) may perform, or may cause performing, the methods (e.g., the processes, steps, operations, actions, and functions) described with respect to various figures, such as FIGS. 3-11, except for those methods described herein as being performed by the display panel 110, the gate driving circuit 120, the data driving circuit 130, and their components. For example, the controller 140 and/or its components (e.g., its/their processor(s)) may perform, or may cause performing, the methods (e.g., the processes, steps, operations, actions, and functions) described herein or describe below, except for those methods described herein as being performed by the display panel 110, the gate driving circuit 120, the data driving circuit 130, and their components.

In one or more examples, the controller 140 (e.g., its processor(s)) may perform, or may cause performing the following: generating a first compensation data for a first subpixel and a second compensation data for a second subpixel; determining a first compression loss level of the first compensation data for the first subpixel and a second compression loss level of the second compensation data for the second subpixel; compressing the first and second compensation data according to the respective compression loss levels; storing the compressed first and second compensation data; restoring the stored first and second compensation data; generating a first driving data signal for the first subpixel based on the restored first compensation data and generating a second driving data signal for the second subpixel based on the restored second compensation data; and/or updating the first compensation data for the first subpixel based on the first driving data signal and updating the second compensating data for the second subpixel based on the second driving data signal. The controller 140 (e.g., its processor(s)) may perform, or may cause performing, similar operations for other subpixels.

In one or more examples, a compensation data may include a plurality of compensation data. In one or more examples, a compensation data for a plurality of subpixels may include one or more compensation data. For example, a compensation data for a plurality of subpixels may include: a first compensation data for a first subpixel among the plurality of subpixels; and a second compensation data for a second subpixel adjacent to the first subpixel. In one or more examples, a compensation data for a plurality of subpixels may include two or more compensation data. In one or more examples, a subpixel may be associated with a corresponding compensation data and vice versa.

In one or more examples, the expression lossless-compression of data may refer to compression of data without loss of the data or without substantial loss of the data. In one or more examples, the expression loss-compression of data may refer to compression of data where some of the data is lost due to compression. In one or more examples, loss-compression causes loss of a greater amount of data than that of lossless-compression.

In one or more examples, a compression loss level may indicate a level (or amount) of data being lost during a compression process. When a size or complexity of a compensation data for a subpixel SP in an area of the display device 100 is great (or large), the compression loss level of the compensation data for the subpixel SP may be high. Similarly, when a size or complexity of a compensation data for a subpixel SP in an area of the display device 100 is small (or low), the compression loss level of the compensation data for the subpixel SP may be low.

In one or more examples, each subpixel may be associated with its corresponding compensation data, and each compensation data may be associated with a corresponding compression loss level; hence, in these examples, the controller 140 may determine a compression loss level for each subpixel in an area of the display device 100. In one or more examples, subpixels in each given area may have the same or similar characteristics and thus may have (or may be associated with) the same compression loss level; hence, the controller 140 may determine a compression loss level for each given area (or for the subpixels in each given area).

Referring to FIGS. 3-11, in one or more examples, the controller 140 may generate a first compensation data, for a first subpixel SP in a first area of the active area AA. The first compensation data may be generated based on (or according to) a driving data signal that has been generated by the controller 140, which is supplied by the controller 140 to the data driving circuit 130 for driving the first subpixel SP. The controller 140 may determine the compression loss level of the first compensation data, using one or more methods described herein (e.g., the methods described with respect to FIGS. 6-11), compress the first compensation data according to the compression loss level, and cause storing the compressed first compensation data, for example, in the storage unit 400. The controller 140 may then restore the first compensation data, using one or more restoring methods described herein. The controller 140 (e.g., the data signal output unit 310) may generate a first driving data signal (which is newer than the driving data signal mentioned above in this paragraph) based on an image data signal and the first compensation data (e.g., the restored first compensation data) for the first subpixel SP. The controller 140 (e.g., the data signal output unit 310) may supply the first driving data signal to the data driving circuit 130 for driving the first subpixel SP. The data driving circuit 130 may generate a first data voltage Vdata based on the first driving data signal and may supply the first data voltage Vdata to the subpixel SP and drive the first subpixel SP. In the meantime, the controller 140 (e.g., the degradation management unit 330) may receive an input stress data for the first subpixel SP corresponding to the first driving data signal and may generate (or determine), for the first subpixel SP, an updated first compensation data based on the input stress data (or the first driving data signal) and the first compensation data (e.g., the restored first compensation data). Thus, the controller 140 may generate an updated first compensation data based on the first driving data signal.

Thereafter, the operations of the controller 140 (e.g., determining the compression loss level, compressing, storing and restoring the updated first compensation data, generating and supplying a new driving data signal, and re-updating the first compensation data) and the operations of the data driving circuit 130 (e.g., generating and supplying to the first subpixel SP a new data voltage) may be repeated. The methods described above can prevent a decrease in display quality due to a degradation of the circuit element disposed in the first subpixel SP and the degradation variation (or deviation) between circuit elements disposed in different subpixels SP.

The process described in the foregoing two paragraphs may be performed for other subpixels (e.g., other subpixels in other areas of the active area AA).

In this regard, in one or more aspects, a driving data signal for a subpixel SP may be generated based on the compensation data (e.g., the restored compensation data) for the subpixel SP. A data voltage Vdata for the subpixel SP may be generated based on the driving data signal for the subpixel SP. Accordingly, in one or more aspects, the data voltage Vdata may be generated based on the compensation data (or the restored compensation data) of the subpixel SP.

A display device 100 according to one or more example embodiments of the present disclosure may include a display panel 110 in which a plurality of subpixels SP are disposed, a data driving circuit 130 configured to supply a data voltage Vdata to a respective one of the plurality of subpixels SP, and a controller 140 configured to control the data driving circuit 130 and process a compensation data for the plurality of subpixels SP.

A difference between a final compression loss level of a first compensation data for a first subpixel disposed in a first area A1 among the plurality of subpixels SP and a final compression loss level of a second compensation data for a second subpixel disposed in a second area A2 adjacent to the first area may be less than or equal to a threshold loss deviation.

An initial compression loss level of the first compensation data may be greater than an initial compression loss level of the second compensation data, and the final compression loss level of the second compensation data may be greater than the initial compression loss level of the second compensation data.

The final compression loss level of the second compensation data may be less than the initial compression loss level of the first compensation data.

The final compression loss level of the first compensation data may be identical to the initial compression loss level of the first compensation data.

A difference between a final compression loss level of a third compensation data for a third subpixel disposed in a third area adjacent to the second area and the final compression loss level of the second compensation data may be less than or equal to the threshold loss deviation.

In this case, a difference between an initial compression loss level of the third compensation data and the final compression loss level of the second compensation data may be greater than the threshold loss deviation. Furthermore, a difference between the initial compression loss level of the third compensation data and the initial compression loss level of the second compensation data may be less than or equal to the threshold loss deviation.

A difference between the final compression loss level of the third compensation data and the final compression loss level of the first compensation data may be less than or equal to the threshold loss deviation.

Alternatively, a difference between the final compression loss level of the third compensation data and the final compression loss level of the first compensation data may be greater than the threshold loss deviation.

A difference between an initial compression loss level of the first compensation data and an initial compression loss level of the second compensation data may be greater than the threshold loss deviation, and a difference between the final compression loss level of the first compensation data and the final compression loss level of the second compensation data may be identical to the threshold loss deviation.

Alternatively, a difference between an initial compression loss level of the first compensation data and an initial compression loss level of the second compensation data may be less than or equal to the threshold loss deviation, and the final compression loss level of the first compensation data may be identical to the initial compression loss level of the first compensation data, and the final compression loss level of the second compensation data may be identical to the initial compression loss level of the second compensation data.

An initial compression loss level of the first compensation data may be different from an initial compression loss level of the second compensation data, and the final compression loss level of the first compensation data may be different from the final compression loss level of the second compensation data.

The controller 140 may update the first compensation data according to a driving data signal that the controller outputs to the data driving circuit 130.

The data driving circuit 130 may generate a second data voltage based on the first compensation data for the first subpixel SP, and supply the second data voltage to the first subpixel to drive the first subpixel.

The controller 140 may compress the first compensation data according to the corresponding final compression loss level, store the compressed first compensation data, and restore the stored first compensation data. The data driving circuit 130 may generate a second data voltage Vdata based on the restored first compensation data and supply the second data voltage Vdata to the first subpixel SP.

A display device 100 according to one or more example embodiments of the present disclosure may include a display panel 110 in which a plurality of subpixels SP are disposed, a data driving circuit 130 configured to supply a data voltage Vdata to a respective one of the plurality of subpixels SP, and a controller 140 configured to control the data driving circuit 130 and process a compensation data for the plurality of subpixels SP, wherein a difference between a compression loss level of a first compensation data for a first subpixel disposed in a first area A1 among the plurality of subpixels SP and a compression loss level of a second compensation data for a second subpixel disposed in a second area A2 adjacent to the first area A1 is greater than a threshold loss deviation and when restoring, a lost level of some of at least one of the first compensation data or the second compensation data is increased. That the lost level is increased when restoring may indicate that a loss level used when restoring of the compensation data is increased and is thus higher than a loss level determined according to the compensation data. For example, the first compensation data may be restored according to a loss level determined according to a size or a complexity of the first compensation data. And the second compensation data may be restored according to a loss level increased and is thus higher than a loss level determined according to a size or a complexity of the second compensation data. In one or more aspects, a loss level may indicate the level (or the amount) of data being lost when the data (e.g., a compensation data) is being restored.

The data driving circuit 130 may generate a second data voltage based on the first compensation data, and supply the second data voltage to the first subpixel SP.

A method for processing and applying a compensation data of a display device 100 having a plurality of subpixels SP, according to one or more example embodiments of the present disclosure, may include generating the compensation data for the plurality of subpixels SP, the compensation data comprising a first compensation data for a first subpixel SP among the plurality of subpixels SP and a second compensation data for a second subpixel SP adjacent to the first subpixel SP; configuring an initial compression loss level of the first compensation data and an initial compression loss level of the second compensation data; comparing the initial compression loss level of the first compensation data and the initial compression loss level of the second compensation data to produce a comparison result; and configuring a final compression loss level of the first compensation data and a final compression loss level of the second compensation data according to the comparison result.

The method may also include: generating a driving data signal based on the first compensation data; generating a data voltage Vdata based on the driving data signal; supplying the data voltage Vdata to the first subpixel SP; driving the first subpixel SP using the data voltage Vdata; updating the first compensation data based on the driving data signal; and supplying to the first subpixel SP a second data voltage based on the updated first compensation data.

A difference between the final compression loss level of the first compensation data and the final compression loss level of the second compensation data may be less than or equal to a difference between the initial compression loss level of the first compensation data and the initial compression loss level of the second compensation data.

A difference between the initial compression loss level of the first compensation data and the initial compression loss level of the second compensation data may be greater than a threshold loss deviation, and the difference between the final compression loss level of the first compensation data and the final compression loss level of the second compensation data may be less than or equal to the threshold loss deviation.

The initial compression loss level of the first compensation data may be greater than the initial compression loss level of the second compensation data, and the final compression loss level of the second compensation data may be configured by increasing the initial compression loss level of the second compensation data.

The above description has been presented to enable any person skilled in the art to make, use and practice the technical features of the present disclosure, and has been provided in the context of a particular application and its requirements as examples. Various modifications, additions and substitutions to the described embodiments will be readily apparent to those skilled in the art, and the principles described herein may be applied to other embodiments and applications without departing from the scope of the present disclosure. The above description and the accompanying drawings provide examples of the technical features of the present disclosure for illustrative purposes. In other words, the disclosed embodiments are intended to illustrate the scope of the technical features of the present disclosure. Thus, the scope of the present disclosure is not limited to the embodiments shown, but is to be accorded the widest scope consistent with the claims. The scope of protection of the present disclosure should be construed based on the following claims, and all technical features within the scope of equivalents thereof should be construed as being included within the scope of the present disclosure.

What is claimed is:

1. A display device, comprising:

a display panel in which a plurality of subpixels are disposed;

a data driving circuit configured to supply a data voltage to a respective one of the plurality of subpixels; and a controller configured to control the data driving circuit, and process a compensation data for the plurality of subpixels, wherein a difference between a final compression loss level of a first compensation data for a first subpixel disposed in a first area among the plurality of subpixels and a final compression loss level of a second compensation data for a second subpixel disposed in a second area adjacent to the first area is less than or equal to a threshold loss deviation.

2. The display device of claim 1, wherein an initial compression loss level of the first compensation data is greater than an initial compression loss level of the second compensation data, and the final compression loss level of the second compensation data is greater than the initial compression loss level of the second compensation data.

3. The display device of claim 2, wherein the final compression loss level of the second compensation data is less than the initial compression loss level of the first compensation data.

4. The display device of claim 2, wherein the final compression loss level of the first compensation data is identical to the initial compression loss level of the first compensation data.

5. The display device of claim 2, wherein a difference between a final compression loss level of a third compensation data for a third subpixel disposed in a third area adjacent to the second area and the final compression loss level of the second compensation data is less than or equal to the threshold loss deviation.

6. The display device of claim 5, wherein a difference between an initial compression loss level of the third compensation data and the final compression loss level of the second compensation data is greater than the threshold loss deviation.

7. The display device of claim 6, wherein a difference between the initial compression loss level of the third compensation data and the initial compression loss level of the second compensation data is less than or equal to the threshold loss deviation.

8. The display device of claim 1, wherein a difference between an initial compression loss level of the first compensation data and an initial compression loss level of the second compensation data is greater than the threshold loss deviation, and a difference between the final compression loss level of the first compensation data and the final compression loss level of the second compensation data is identical to the threshold loss deviation.

9. The display device of claim 1, wherein a difference between an initial compression loss level of the first compensation data and an initial compression loss level of the second compensation data is less than or equal to the threshold loss deviation, and the final compression loss level of the first compensation data is identical to the initial compression loss level of the first compensation data, and the final compression loss level of the second compensation data is identical to the initial compression loss level of the second compensation data.

10. The display device of claim 1, wherein an initial compression loss level of the first compensation data is different from an initial compression loss level of the second compensation data, and the final compression loss level of the first compensation data is different from the final compression loss level of the second compensation data.

11. The display device of claim 1, wherein the controller is configured to update the first compensation data according to a driving data signal that the controller outputs to the data driving circuit.

12. The display device of claim 1, wherein the data driving circuit is configured to:

generate a second data voltage based on the first compensation data for the first subpixel; and supply the second data voltage to the first subpixel to drive the first subpixel.

13. The display device of claim 1, wherein:

the controller is configured to compress the first compensation data according to the corresponding final compression loss level, store the compressed first compensation data, and restore the stored first compensation data; and the data driving circuit is configured to generate a second data voltage based on the restored first compensation data and supply the second data voltage to the first subpixel.

14. A display device, comprising:

a display panel in which a plurality of subpixels are disposed;

a data driving circuit configured to supply a data voltage to a respective one of the plurality of subpixels; and a controller configured to control the data driving circuit, and process a compensation data for the plurality of subpixels, wherein a difference between a compression loss level of a first compensation data for a first subpixel disposed in a first area among the plurality of subpixels and a compression loss level of a second compensation data for a second subpixel disposed in a second area adjacent to the first area is greater than a threshold loss deviation, and when restoring, a lost level of some of at least one of the first compensation data or the second compensation data is increased.

15. The display device of claim 14, wherein the data driving circuit is configured to:

generate a second data voltage based on the first compensation data; and supply the second data voltage to the first subpixel.

16. A method for processing and applying a compensation data of a display device having a plurality of subpixels, the method comprising:

generating the compensation data for the plurality of subpixels, the compensation data comprising a first compensation data for a first subpixel among the plurality of subpixels and a second compensation data for a second subpixel adjacent to the first subpixel;

configuring an initial compression loss level of the first compensation data and an initial compression loss level of the second compensation data;

comparing the initial compression loss level of the first compensation data and the initial compression loss level of the second compensation data to produce a comparison result; and configuring a final compression loss level of the first compensation data and a final compression loss level of the second compensation data according to the comparison result, wherein a difference between the final compression loss level of the first compensation data and the final compression loss level of the second compensation data is less than or equal to a difference between the initial compression loss level of the first compensation data and the initial compression loss level of the second compensation data.

17. The method of claim 16, comprising:

generating a driving data signal based on the first compensation data;

generating a data voltage based on the driving data signal;

supplying the data voltage to the first subpixel;

updating the first compensation data based on the driving data signal; and supplying to the first subpixel a second data voltage based on the updated first compensation data.

18. The method of claim 16, wherein a difference between the initial compression loss level of the first compensation data and the initial compression loss level of the second compensation data is greater than a threshold loss deviation, and the difference between the final compression loss level of the first compensation data and the final compression loss level of the second compensation data is less than or equal to the threshold loss deviation.

19. The method of claim 18, wherein the initial compression loss level of the first compensation data is greater than the initial compression loss level of the second compensation data, and the final compression loss level of the second compensation data is configured by increasing the initial compression loss level of the second compensation data.

* * * * *